US005733374A

United States Patent [19]

Ekenberg

[11] Patent Number: 5,733,374

[45] Date of Patent: Mar. 31, 1998

[54] PAINTING BOOTH AND ROBOTIC PAINTING INSTALLATION THEREFOR

[76] Inventor: Tor Ekenberg, P.O. Box 3014, N-4300 Sandnes, Norway

[21] Appl. No.: 578,540

[22] PCT Filed: Jul. 19, 1993

[86] PCT No.: PCT/NO93/00117

§ 371 Date: Jan. 19, 1996

§ 102(e) Date: Jan. 19, 1996

[87] PCT Pub. No.: WO95/03133

PCT Pub. Date: Feb. 2, 1995

[51] Int. Cl.[6] ..... B05B 3/00; B05B 1/28

[52] U.S. Cl. ..... 118/323; 118/326

[58] Field of Search ..... 118/323, 326, 118/305, 324; 318/568.11, 568.12, 568.13

[56] References Cited

U.S. PATENT DOCUMENTS

| | | | |
|---|---|---|---|
| 4,611,695 | 9/1986 | Kato et al. | 118/323 |
| 4,920,500 | 4/1990 | Hetland et al. | 118/323 |
| 5,213,620 | 5/1993 | Meyer | 118/323 |

FOREIGN PATENT DOCUMENTS

| | | |
|---|---|---|
| 0 536 459 A1 | 4/1993 | European Pat. Off. . |
| 9114509 | 10/1991 | WIPO . |

*Primary Examiner*—Donald E. Czaja
*Assistant Examiner*—Calvin Padsell
*Attorney, Agent, or Firm*—Bacon & Thomas

[57] ABSTRACT

A robot installation for painting objects inside a painting booth (CA) having walls (WA, WB) isolating the object (AU) to be painted from the surroundings, is suitably integrated in the booth walls in order to save interior booth space and achieve a robot operation better adapted to the painting process. The installation includes at least one main robot shaft (RS) associated with a painting tool and protruding through at least one slot (LS) penetrating the booth walls for servo-controlled movements along such slots and possibly also in the direction of and/or about the axis of the shaft. Servo-drive means are disposed for controlling the robot shaft movements in accordance with a preprogrammed motional pattern for the painting tool, including tracking of a travelling object to be painted. The slot is disposed on a rotatable element e.g., a disk or cylinder (CD,SC) supported in or on the booth walls, and the servo-drive means includes means for controlling the rotational movements of the rotatable element in accordance with a preprogrammed motional pattern.

11 Claims, 6 Drawing Sheets

PAINTING BOOTH AND ROBOTIC PAINTING INSTALLATION THEREFOR

This application is a National Stage Application filed under 35. U.S.C. 371 PCT/NO93/00117 filed Jul. 19, 1993.

FIELD OF THE INVENTION

The present invention is related to a painting booth and robot installation for painting objects inside the painting booth, wherein the booth has walls isolating the object to be painted from the surroundings.

RELATED ART

Programmable robots are generally known in the art and well described in the literature. Special types of such robots are designed to be used for painting of certain objects, e.g. motor cars, and a robot of this type may be "taught" or preprogrammed by a skilled operator to perform the appropriate movements of a painting tool in order to apply a prescribed layer of paint to a selected part of the motor car body.

Painting of motor cars on an industrial scale usually takes place in painting booths, through which the car bodies are moved on conveyors in line succession. Such booths may secure sufficient isolation of the health injurious painting areas from the environments.

For external painting of car bodies in such booths, simple and economical reciprocators or the like are usually used. Apparatus of this type may have a sufficient range of reciprocal motion in the vertical direction, but have rather limited ranges of motion in the transverse direction of the painting booth, and practically no option for tracking the object to be painted in the direction of the conveyor motion through the booth. Several such reciprocators having overlapping working ranges along the length of direction of the -booth must then be used to maintain a reasonable conveyor speed and paint coverage.

In order to achieve a uniform layer of paint and optimum painting quality, the paint must be sprayed from the painting tool in a controlled manner normal to the surface to be covered. The motion pattern of the tool must then be correspondingly programmed in relation to the curved surfaces and edges of the car body. This can only be accomplished by means of robot manipulators with six or more axes of motion, which also would allow efficient tracking of the object to be painted and higher conveyor speed through the painting booth. Such robots must then be located in the painting booth itself, which would require considerably wider booths than with the reciprocator embodiment discussed above.

Wider booths would, however, require larger volume flow of venting air through the booth, and the extended movements of the manipulator parts of robots with many axes of motion, which are located within the booth, may well set up turbulence or disturbance in the air flow.

It is, however, essential that the flow of air along the object to be painted is uniform, in order not to disturb the dispersed atomized paint particles directed from the painting tool towards the surfaces to be uniformly painted.

As explained above, both the use of wall mounted reciprocator and location of advanced robots within the painting booth have certain disadvantages. It is therefore a main object of the present invention to provide a robot installation that to a great extent would overcome all such disadvantages.

It should be noted, however, that the present invention is solely directed to the mounting and installation for robots for the above and similar purposes and is not concerned with the design or construction of the painting robots per se, or with the programming of robots for efficient and satisfactory painting operations consistent with the form and movements of the objects to be painted.

Such design and programming are well described elsewhere, e.g. in GB Pat. No. 1.431.413 and U.S. Pat. No. 4.920.500 owned in common with the present application.

SUMMARY OF THE INVENTION

This invention concerns a painting booth and robot installation for painting objects inside the painting booth, wherein the booth has walls isolating the object to be painted from the surroundings, and wherein the robot installation comprises at least one robot shaft associated with i.e., connected to, a painting tool and protruding through at least one slot penetrating a booth wall for servo-controlled movement along the length of said slot and possibly also in the direction of and/or about the axis of said shaft, and servo-drive means controlling said robot shaft movements in accordance with a preprogrammed movement pattern for said painting tool. The slot length extends substantially parallel to the booth wall penetrated by the slot.

More specifically, a novel feature of the invention is that the slot is disposed on a rotatable element supported in or on a painting booth wall or walls, the servo-drive means comprising means for controlling the rotational movements of the rotatable element in accordance with the preprogrammed movement pattern.

The rotatable element may be a circular disc disposed for rotational movements in a plane identical or parallel with the plane of a booth wall, the slot length extending preferably along a diameter of the disc, or alternatively a preferably hollow cylinder disposed for rotational movements about a preferably vertical axis in or parallel with one of the booth walls, with the robot shaft protruding through at least one slot having a length extending substantially parallel with the rotational axis. In both cases, efficient tracking in the travelling direction of the object to be painted is achieved by rotation of the rotatable element, possibly in combination with the movements of the robot shaft in the slot.

Advantageously, servo-drive means may be located within the hollow cylinder for actuating the movements of the robot shaft in the slot by means of pivotal motions about at least two axes. Also, in practice the robot shaft may be connected with the painting tool through manipulator link means having at least one and preferably three or more axes of motion.

BRIEF DESCRIPTION OF THE DRAWINGS

The robot installation according to the invention will now be further explained by means of exemplified embodiments with reference to the accompanying drawings, whereon.

DETAILED DESCRIPTION

As the present invention is not concerned with the design and construction of robot manipulators or their component parts per se, but merely with suitable painting booth wall integration of certain movable robot elements, only the elements involved in such integration are illustrated at least schematically in the figures and described below.

Figure 1:
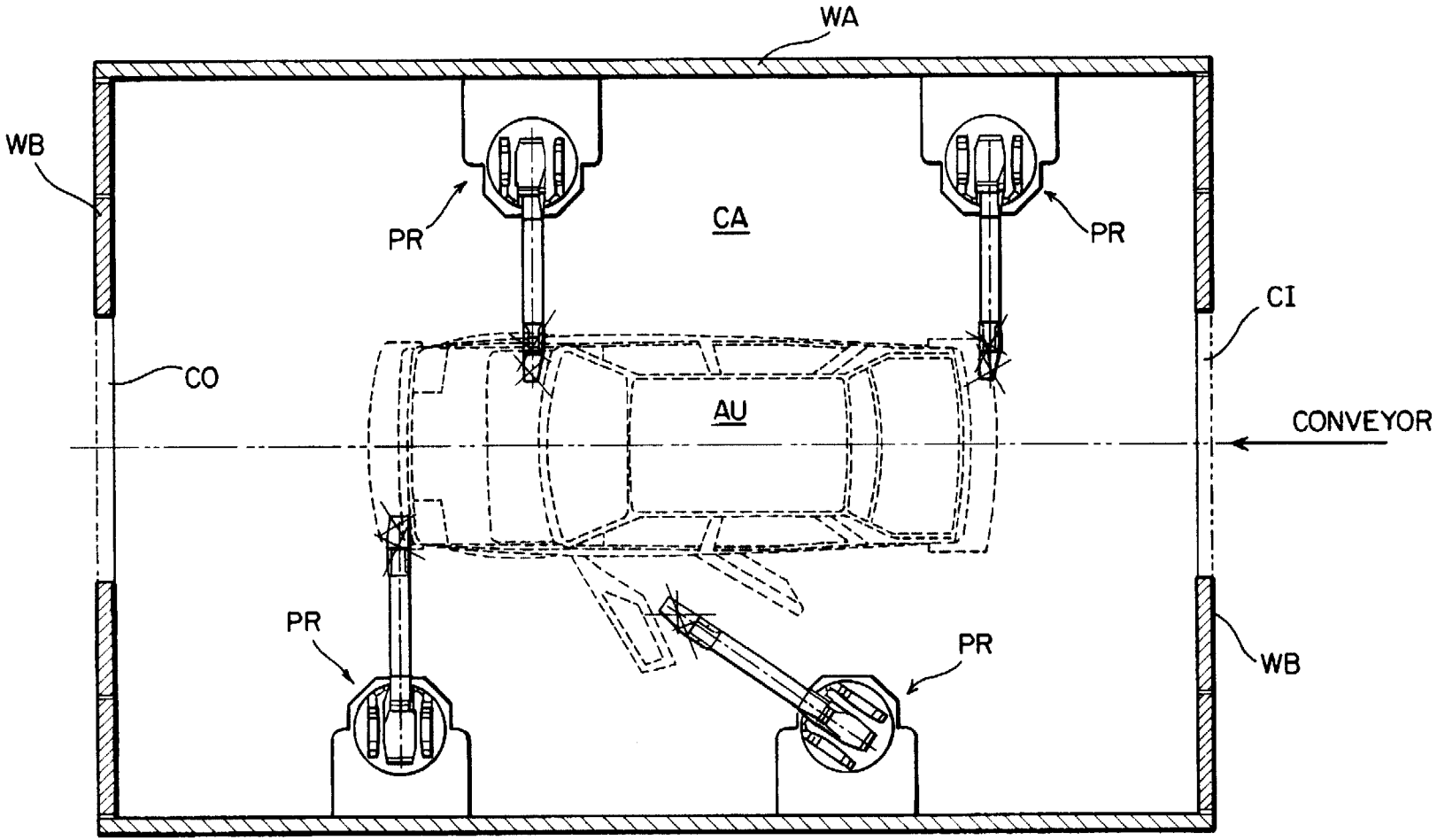
FIG. 1 (PRIOR ART)
FIG. 1 shows schematically a prior art painting booth having four painting robots mounted inside the booth.

In FIG. 1, a convention painting booth CA having side walls WA and end walls WB is shown schematically in section in a plan view with a motor car body AU situated centrally in the booth. Also, four painting robots PR are suitably located in the booth along the side walls for efficient painting of the motor car body. These robots are advanced robot manipulators having a large number of axes of motion and are consequently able to efficiently perform detailed painting operations in accordance with a "pre-taught" painting program adapted to the particular type of motor car body in question.

Motor car bodies of this type are then moved in succession on a conveyor (indicated by a thick arrow in FIG. 1) into and through the painting booth CA, having inlet and outlet opening CI, CO for this purpose, the intermittent conveyor speed being adapted to the painting program of the robot manipulators PR that includes servo-drive device or devices for allowing uniform paint coverage and optimum tracking of the moving car bodies AU by the painting robots.

As evident from FIG. 1, the painting robots PR are in this conventional embodiment occupying an unduly large portion of the booth volume. Also, the large moving parts of the robot manipulators and their extensive movements are likely to set up turbulence in the flow of venting air through the booth, which may negatively affect the uniformity of the layer of paint sprayed onto the car body surface in atomized form.

These disadvantages may be overcome to a large extent by means of a narrower booth provided with simple reciprocators for the painting of the motor cars by means of painting tools mounted on arms extending through narrow slots in the booth walls and disposed for vertical reciprocating movements along the slots, as discussed above.

However, with such a solution the quality of the painting would be largely degraded, which is not feasible in many cases, where uniform paint coverage and an always reliable painting process are primary requirements.

Hence, in order to combine a narrow booth with robot manipulators able to produce high quality painting with reduced venting air agitation, it is suggested according to the invention to integrate the robots with the painting booth walls.

Figure 2:
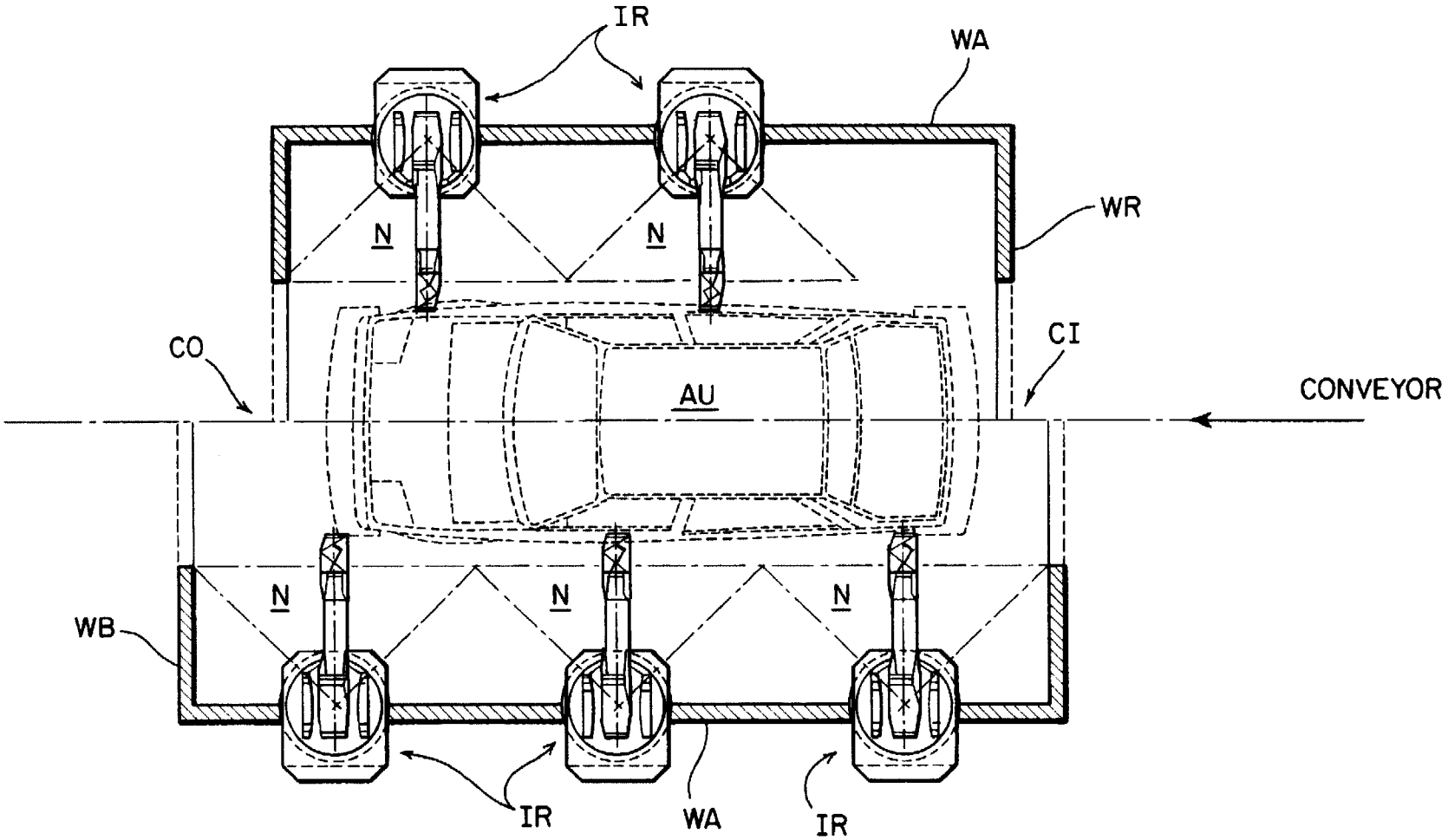
FIG. 2 shows schematically a painting booth having wall integrated robots according to the invention.

Such a painting booth CA with wall integrated robot installations IR is illustrated in FIG. 2, in which a booth of the same general design as the one in FIG. 1 is shown in the same format and with the same reference characters indicating corresponding components. Here a booth embodiment with two wall integrated robots and a shorter booth is shown in the upper portion of the figure, whereas an embodiment with three wall integrated robots and extended booth length is shown in the lower portion. In both cases, the operating fields of the various robots are indicated with the designation N. In this manner, robot installations with wide operations fields and ample tracking abilities are realized in combination with reduced painting booth dimensions.

Figure 3:
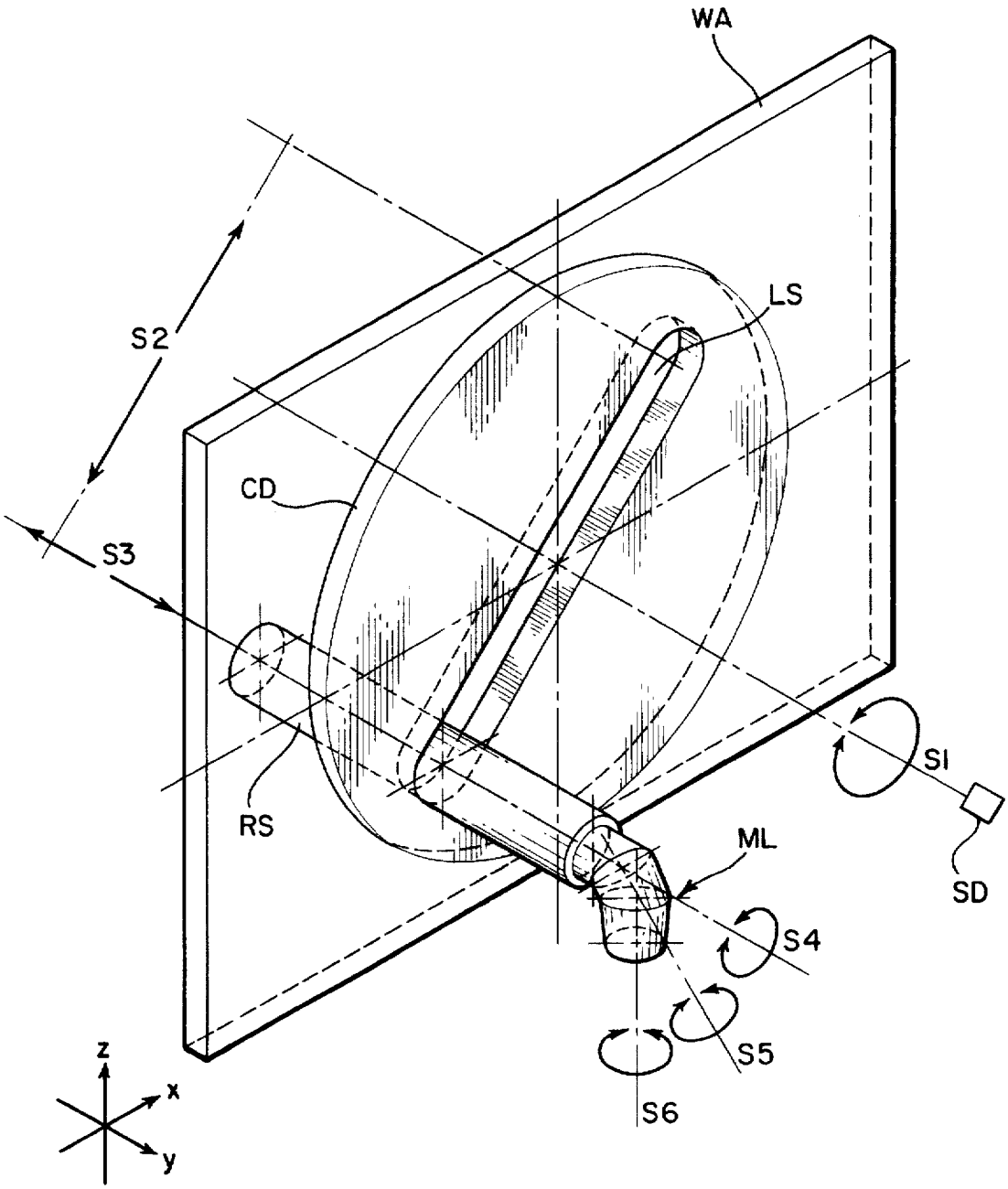
FIG. 3 shows in principle the wall integration of a rotatable, slotted element with protruding robot shaft according to the invention in a first embodiment, in which said element is a slotted disc.

One way of integrating a robot manipulator in a booth wall is illustrated in FIG. 3. Here, a circular disc CD having a diametrical elongate slot LS is rotatably supported in and substantially parallel with a plane including the booth wall WA. Such rotatable support may be realized by any suitable means known in the art. The range of rotation may be a full revolution or a suitable fraction of the same, e.g. a half or a quarter of a revolution. The main manipulator shaft RS protrudes through the diametrical slot and is disposed for translational motions along the slot length and in the axial direction of the shaft.

Thus, by means of the slotted disc CD and the protruding shaft RS, three axes of motion may be realized for the robot manipulator, i.e. the rotational axis of the disc, indicated by S1, the translational movement of the shaft along the slot length, indicated by S2, and the translational movement of said shaft in the direction of the shaft axis, indicated by S3 in the figure. By these means, coarse positioning of the painting tool in accordance with a set painting program may be performed by a servo-controlled drive means SD for the rotatable disc and the usual servo-drive means for the robot shaft, in all three Cartesian coordinates x, y and z indicated in FIG. 3, i.e., the length, width and height dimension respectively, of the painting booth. An efficient tracking function in the x direction may then be provided by the wall-based axis S1, possibly in combination with the other wall-based axes of motion S2 and S3.

The finer and exact positioning of the tool is then achieved through the axes of motion S4, S5, S6 provided by the wrist manipulator link ML, which connects the robot shaft RS with the painting tool and is controlled by the usual servo-drive means.

Figure 4:
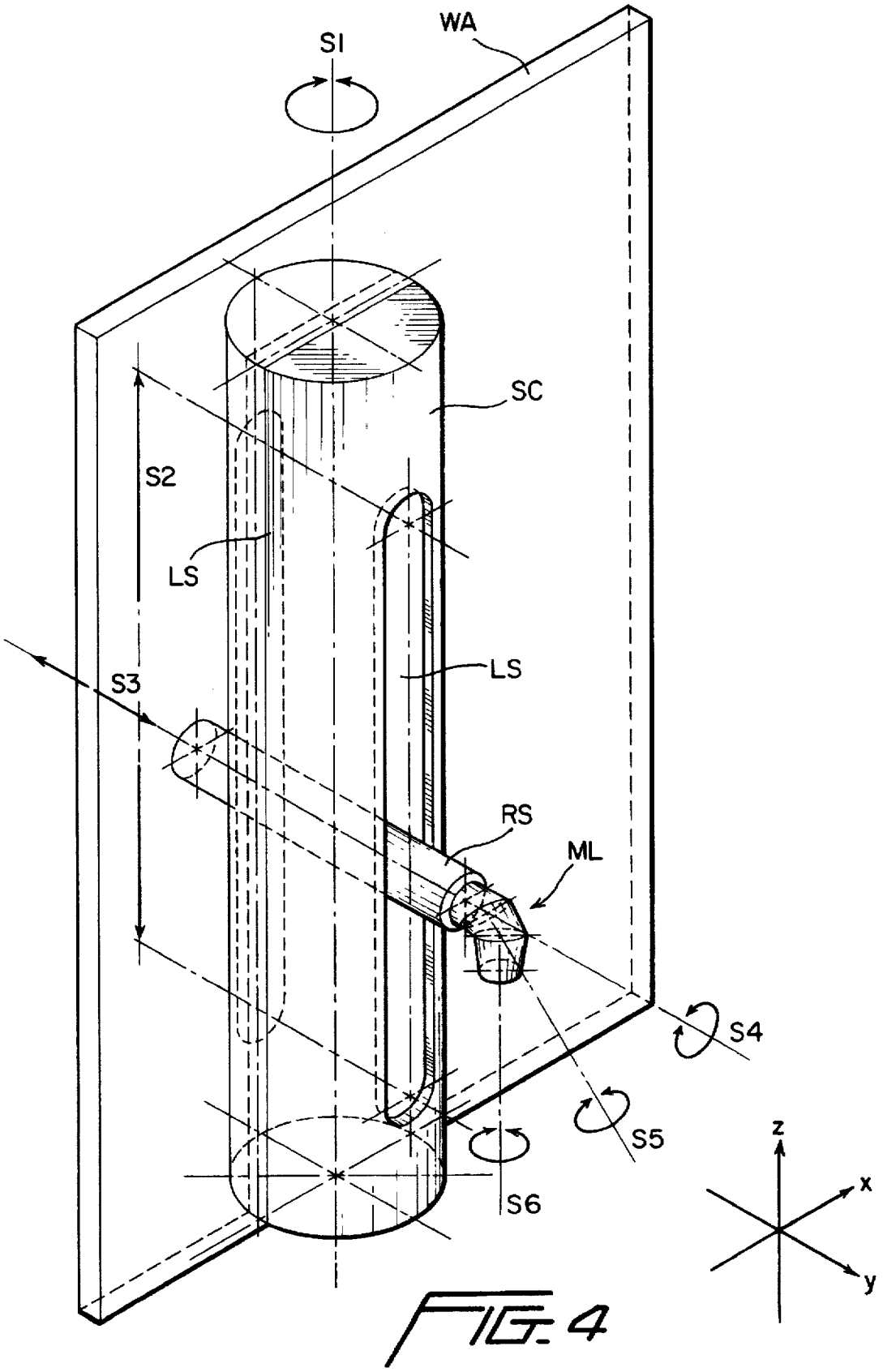
FIGS. 4–6 show in principle the wall integration of rotatable slotted elements with protruding robot shafts according to the invention according to further embodiments, in which said elements are slotted cylinders.

Another embodiment of the wall integration of said rotatable element of the painting robot is illustrated in principle in FIG. 4. Here the rotatable element is a hollow slotted cylinder SC supported vertically in in substantially parallel with the booth wall for rotational movements about the central axis of the cylinder. The main robot shaft protrudes through a pair of mutually aligned slots LS extending through the cylinder walls and having lengths that extend parallel with the cylinder axis.

The coarse robot movements in the directions of the said coordinates x, y and z corresponding to the booth dimensions mentioned above, may in this case be realized through the rotation of the cylinder SC about its central axis, indicated by the axis of motion S1, together with translational movements of the main robot shaft RS along and perpendicular to the slot length, corresponding to the indicated axes of motion S2 and S3 respectively. Also, in this case an efficient tracking function in the x direction may be achieved by means of the wall-based axes of motion S1, S2 and S3.

Figure 5:
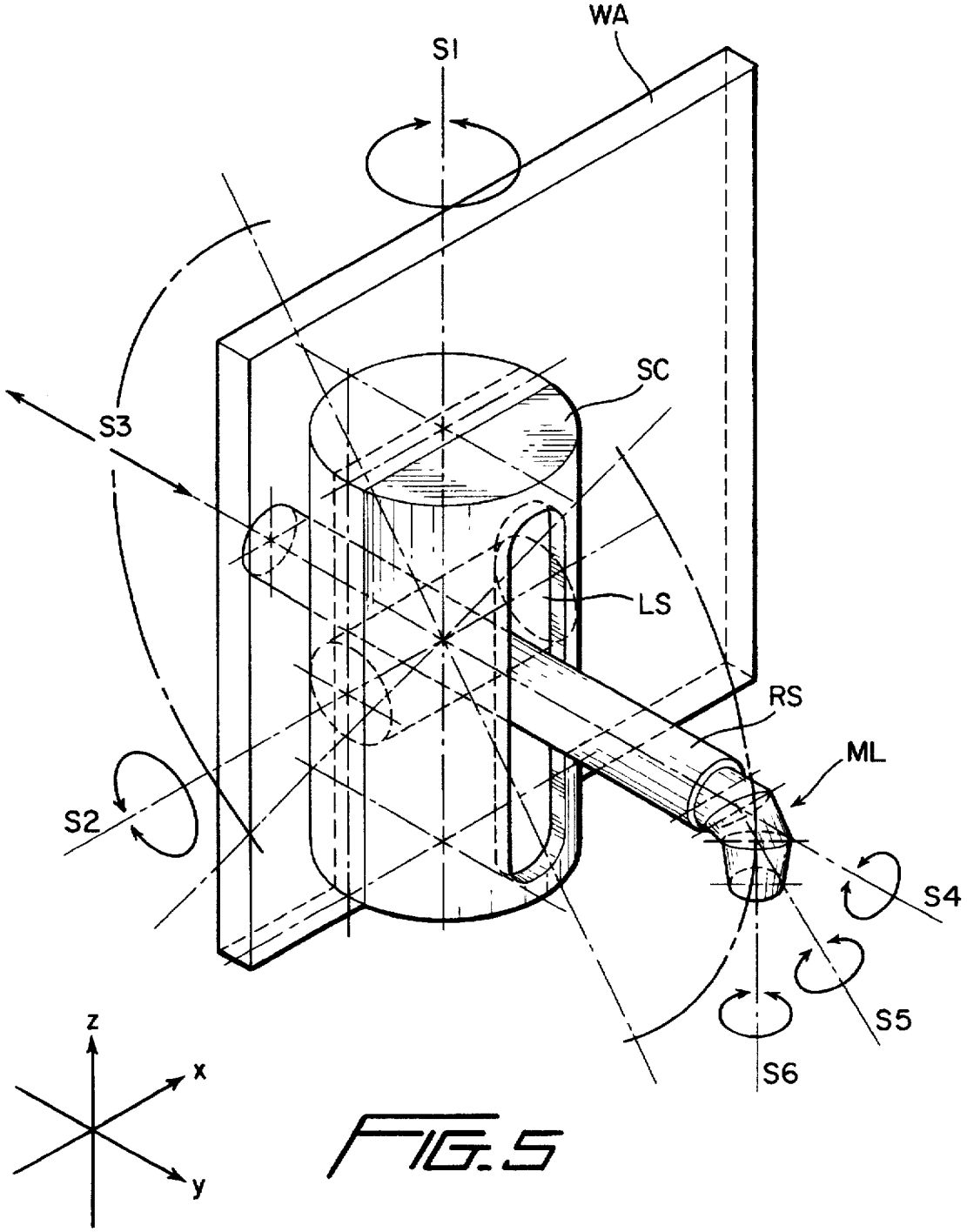

In FIG. 5, an embodiment of the same type as illustrated in FIG. 4, is shown comprising a rotatable cylinder integrated in the booth wall, with the only difference being that the main robot shaft RS is pivotally supported in the cylinder itself, rather than disposed for translational movements along the slot length. Thus, the latter translation movement is here substituted by a pivotal movement in a considerably shorter pair of cylinder slots LS, as indicated by the shown rotational axis of motion S2, the other axes of motion S1 and S3 being the same as in FIG. 4.

In this manner the same coarse servo-controlled robot movements along the said Cartesian axes x, y and z, and associated object tracking as explained earlier may be realized.

Figure 6:
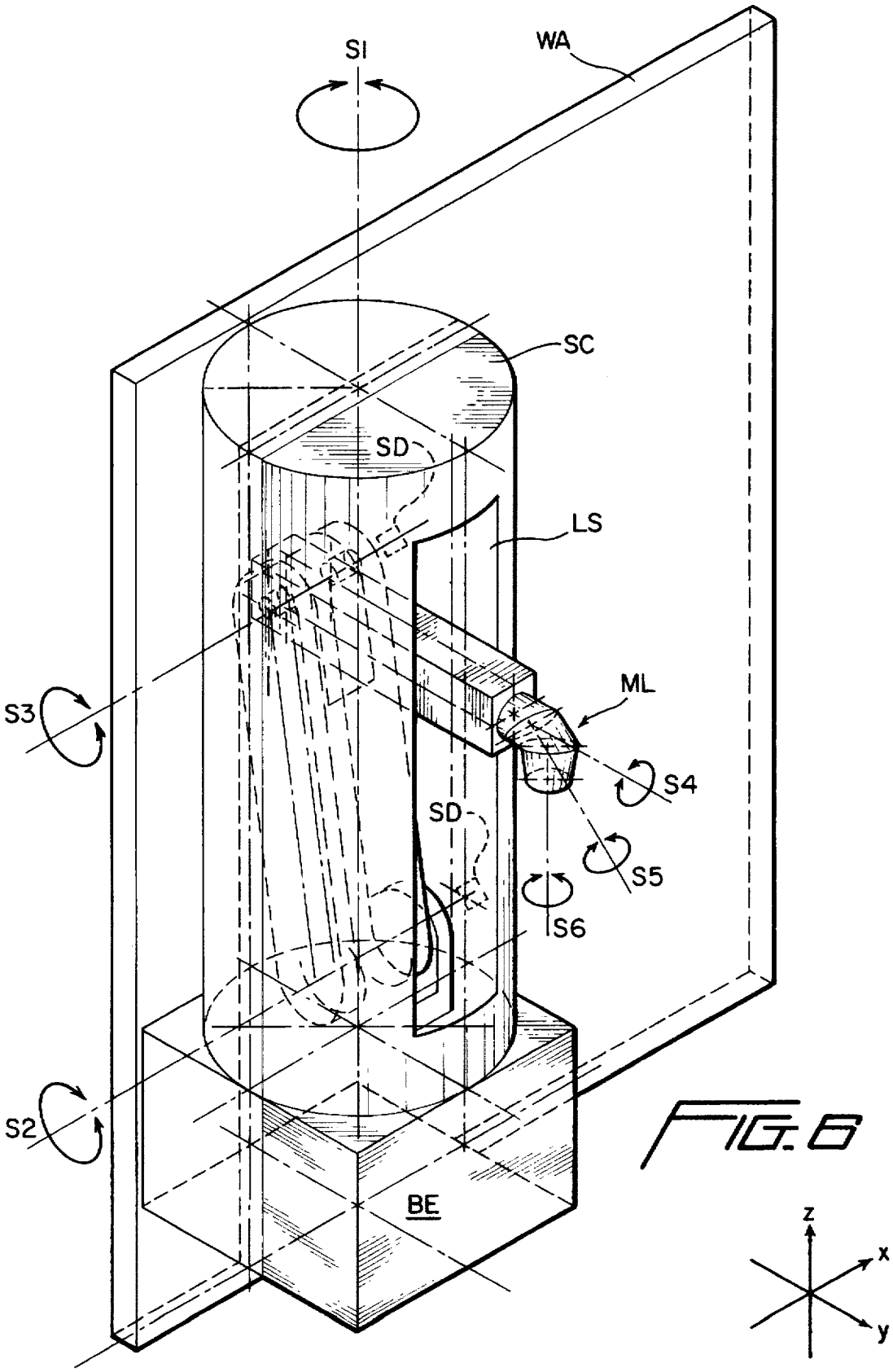

In FIG. 6 there is shown a wall integrated rotatable element in the form of a hollow cylinder SC. In this case, the cylinder is appropriately supported on a more solid base, as the servo-drive machinery SD is located into the cylinder itself, the main robot shaft protruding through a single slot in the cylinder wall. Here, the wall-based coarse robot movements in the x, y and z directions are realized by means of three rotational axes of motion, S1, S2 and S3, respectively, which also may enable the intended object tracking discussed above.

As in the embodiment shown in FIG. 3, also with the latter embodiments illustrated in the FIGS. 4, 5 and 6, the finer servo-controlled movements of the painting tool are performed about the additional axes of motion S4, S5 and S6 of the wrist manipulator link ML.

With the wall integrated robot installations according to the invention, considerably reduced dimensions of painting booths are achieved, while maintaining large operational fields for the integrated robot manipulators. Efficient tracking functions are provided in the direction of the conveyor motion (the x direction) even with very narrow booths. Due to the wall integration of several axes of motion of the robot manipulators, a reduced number and size of movable components would be operating in the interspace between the booth walls and the object to be painted, e.g., a motor car body, which means less turbulence (disturbance) in the venting air through the booth and thereby a more uniform paint coverage.

Practical wall integrated test installations have shown that savings on the order of 10–25% may be achieved in the width dimension of the booth (the y direction). Due to more efficient tracking, a booth length reduction of up to 25% also may be achieved in the length direction (the x direction). Reduction on the order of 10–40% in the booth volume to be vented are then obtainable, which means less venting air, less air turbulence and less disturbance of the painting process.

I claim:

1. A painting booth and robotic installation for painting of objects inside the booth, the booth having walls for isolating an object to be painted from the surroundings, at least one of said walls including at least one elongate slot penetrating the wall, said robotic installation comprising at least one robot shaft connected to a painting tool and protruding through said at least one slot for robotic controlled servo-controlled movements at least along the length of said slot, and servo-drive means positioned and arranged for controlling said robot shaft movements in accordance with a preprogrammed movement pattern for said painting tool; said slot being disposed on a rotatable element connected to the at least one wall and having a slot length extending generally parallel to the at least one wall, the servo-drive means comprising means positioned and arranged for controlling the rotational movements of said rotatable element in accordance with a preprogrammed movement pattern.

2. The painting booth and robotic installation as claimed in claim 1, wherein said rotatable element comprises a circular disc disposed for rotational movements in a plane extending parallel or in coincidence with the plane of said booth wall, said slot length extending generally along a diameter of said disc.

3. The painting booth and robotic installation as claimed in claim 1, wherein said rotatable element comprises a hollow cylinder disposed for rotational movement about an axis extending parallel with said wall, said robot shaft protruding through said slot, said slot length extending substantially parallel with said rotational axis.

4. The painting booth and robotic installation as claimed in claim 3, wherein the robot shaft is disposed for translational movements along the slot length under the control of the servo-drive means.

5. The painting booth and robotic installation as claimed in claim 3, wherein the robot shaft is disposed for pivotal movements in the slot, and is controlled by the servo-drive means at least about a pivot axis located inside the hollow cylinder.

6. The painting booth and robotic installation as claimed in claim 5, wherein the servo-drive means is located within said hollow cylinder and is positioned and arranged arranged to actuate the movements of said robot shaft in the slot by means of pivotal motions about at least two axes.

7. The painting booth and robotic installation as claimed in claim 6, wherein the robot shaft is connected with the painting tool through a manipulator link means having at least one axis of motion.

8. The painting booth and robotic installation as claimed in claim 5, wherein the robot shaft is connected with the painting tool through a manipulator link means having at least one axis of motion.

9. The painting booth and robotic installation as claimed in claim 1, wherein the robot shaft is connected with the painting tool through a manipulator link means having at least one axis of motion.

10. The painting booth and robotic installation as claimed in claim 1, wherein the robotic installation is positioned and arranged arranged to control movement of the robot shaft along and about the axis of the shaft.

11. The painting booth and robotic installation as claimed in claim 9, wherein the connection of the robot shaft with the painting tool is arranged to enable movement of the manipulator link means about at least three axes of motion.

* * * * *